US010360828B2

(12) United States Patent
Pyo et al.

(10) Patent No.: US 10,360,828 B2
(45) Date of Patent: Jul. 23, 2019

(54) APPLICATION PROCESSOR AND DISPLAY DEVICE INCLUDING THE SAME

(71) Applicant: SAMSUNG DISPLAY CO., LTD., Yongin-si, Gyeonggi-do (KR)

(72) Inventors: Dong-Hak Pyo, Hwaseong-si (KR); Cheol-Hwan Eom, Hwaseong-si (KR); Sang-Myeon Han, Hwaseong-si (KR); Sun-Joon Hwang, Cheonan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 86 days.

(21) Appl. No.: 15/399,284

(22) Filed: Jan. 5, 2017

(65) Prior Publication Data

US 2017/0206819 A1 Jul. 20, 2017

(30) Foreign Application Priority Data

Jan. 19, 2016 (KR) ..... 10-2016-0006343

(51) Int. Cl.
*G09G 3/00* (2006.01)
*G09G 3/3258* (2016.01)

(52) U.S. Cl.
CPC ..... *G09G 3/006* (2013.01); *G09G 3/3258* (2013.01); *G09G 2310/0243* (2013.01); *G09G 2310/08* (2013.01); *G09G 2320/0233* (2013.01); *G09G 2320/0295* (2013.01); *G09G 2320/045* (2013.01); *G09G 2320/0626* (2013.01)

(58) Field of Classification Search
None
See application file for complete search history.

(56) References Cited

U.S. PATENT DOCUMENTS

2014/0168039 A1* 6/2014 Kim ..... G09G 3/3208 345/82

FOREIGN PATENT DOCUMENTS

KR 1020110014185 2/2011
KR 1020150076783 7/2015

* cited by examiner

*Primary Examiner* — Jeffrey J Chow
(74) *Attorney, Agent, or Firm* — F. Chau & Associates, LLC

(57) ABSTRACT

An application processor includes a scaling rate calculator that determines a scaling rate of first image data based on stress data that includes pixel degradation information for each pixel; and an image processor that generates second image data by decreasing a maximum grayscale value of the first image data based on the scaling rate, where the first image data is received from an external component.

16 Claims, 7 Drawing Sheets

FIG. 3

300

AGE

INPUT GRAY

| 8bit | 13bit | 0 | 1 | 2 | 3 | 4 | 5 | … | 1021 | 1022 | 1023 |
|---|---|---|---|---|---|---|---|---|---|---|---|
| 0 | 0 | 0 | 0 | 0 | 0 | 0 | 0 | … | 0 | 0 | 0 |
| 1 | 32 | 32 | 34 | 36 | 38 | 40 | 41 | … | 64 | 64 | 65 |
| 2 | 64 | 64 | 66 | 68 | 70 | 72 | 73 | … | 94 | 94 | 95 |
| 3 | 96 | 96 | 98 | 100 | 102 | 105 | 106 | … | 129 | 130 | 130 |
| 4 | 128 | 128 | 130 | 132 | 134 | 136 | 137 | … | 167 | 167 | 168 |
| 5 | 160 | 160 | 164 | 167 | 169 | 171 | 173 | … | 194 | 195 | 196 |
| … | … | … | … | … | … | … | … | … | … | … | … |
| … | … | … | … | … | … | … | … | … | … | … | … |
| 251 | 8032 | 8032 | 8043 | 8078 | 8115 | 8159 | 8186 | … | 8192 | 8192 | 8192 |
| 252 | 8064 | 8064 | 8090 | 8121 | 8157 | 8185 | 8192 | … | 8192 | 8192 | 8192 |
| 253 | 8096 | 8096 | 8135 | 8167 | 8183 | 8192 | 8192 | … | 8192 | 8192 | 8192 |
| 254 | 8128 | 8128 | 8172 | 8189 | 8192 | 8192 | 8192 | … | 8192 | 8192 | 8192 |
| 255 | 8160 | 8160 | 8181 | 8192 | 8192 | 8192 | 8192 | … | 8192 | 8192 | 8192 |
| 256 | 8192 | 8192 | 8192 | 8192 | 8192 | 8192 | 8192 | … | 8192 | 8192 | 8192 |
| SR_ISC | | 1.000 | 0.995 | 0.992 | 0.988 | 0.984 | 0.982 | … | 0.723 | 0.715 | 0.709 |

FIG. 6A

```
SR_ISC = SEL0 0: 1
         SEL0 1: min(SR_ISC_R, SR_ISC_G, SR_ISC_B)

if ( SRdefault > SR_ISC)

  SEL1 0 : SRdef+ISC = SR_ISC
  SEL1 1 : SRdef+ISC = SRdefault * SR_ISC

 else

  SEL1 0 : SRdef+ISC = SRdefault
  SEL1 1 : SRdef+ISC = SRdefault * SR_ISC
```

APPLICATION PROCESSOR AND DISPLAY DEVICE INCLUDING THE SAME

CROSS-REFERENCE TO RELATED APPLICATION(S)

This application claims priority under 35 USC § 119 from, and the benefit of, Korean Patent Application No. 10-2016-0006343, filed on Jan. 19, 2016 in the Korean Intellectual Property Office (KIPO), the contents of which are herein incorporated by reference in their entirety.

BACKGROUND

1. Technical Field

Exemplary embodiments are directed to a display device. More particularly, embodiments of the present inventive concept are directed to an application processor and a display device including an application processor.

2. Discussion of the Related Art

An organic light emitting display device displays an image using an organic light emitting diode. An organic light emitting diode includes a driving transistor, which provides a current to the organic light emitting diode over time. However, degradation of the organic light emitting diode or the driving transistor, a phenomenon referred to as "pixel degradation", may cause an organic light emitting display device to not display an image with a desired luminance.

An organic light emitting display device can compensate image data, or a grayscale value for each pixel, by calculating an amount of pixel degradation and by adding compensation data or compensation grayscale values for each pixel to the image data based on the amount of pixel degradation. However, there are limitations to compensating pixel degradation. Because the range of grayscale values used in an organic light emitting display device is fixed, the compensation margin, e.g., a range of compensation grayscale values, is limited within, or less than, the range of grayscale values. For example, when the amount of pixel degradation is relatively large, the compensation data for the pixel may exceed the compensation margin, and an organic light emitting display device may not compensate the pixel degradation sufficiently or accurately.

SUMMARY

Some exemplary embodiments provide an application processor to ensure a sufficient compensation margin for pixel degradation.

Some exemplary embodiments provide a display device to compensate pixel degradation with a sufficient compensation margin for pixel degradation.

According to exemplary embodiments, an application processor includes a scaling rate calculator that determines a scaling rate of first image data based on stress data that includes pixel degradation information for each pixel, where the first image data is received from an external component; and an image processor that generates second image data by decreasing the maximum grayscale value of the first image data based on the scaling rate.

In exemplary embodiments, the scaling rate calculator may calculate the scaling rate of the first image data based on the pixel degradation information and a look-up table, and the look-up table may include the scaling rate, and the scaling rate is predetermined based on the pixel degradation information.

In exemplary embodiments, the look-up table may further include a compensation grayscale value which is calculated based on an input grayscale value of the first image data and the pixel degradation information, where the scaling rate is greater than or equal to a ratio of the input grayscale value to the compensation grayscale value, and the compensation grayscale value may be equal to a maximum grayscale value that is usable in the second image data.

In exemplary embodiments, the scaling rate calculator may select maximum pixel degradation information from a maximum stress data value and may calculate the scaling rated of the first image data based on the maximum pixel degradation information.

In exemplary embodiments, the scaling rate calculator may compare the scaling rate and an initial scaling rate and may compensate the scaling rate to be equal to the initial scaling rate when the initial scaling rate is less than the scaling rate.

In exemplary embodiments, the scaling rate calculator may compensate the scaling rate based on a current-limit-scaling rate, where the current-limit-scaling rate is a reduction ratio of the first image data that is calculated based on an on-pixel ratio of the first image data.

In exemplary embodiments, the scaling rate calculator may compare the scaling rate and the current-limit-scaling rate and may compensate the scaling rate to be equal to the current-limit-scaling rate when the current-limit-scaling rate is less than the scaling rate.

In exemplary embodiments, the scaling rate calculator may compensate the scaling rate in proportion to the current-limit-scaling rate.

In exemplary embodiments, the image data may include sub image data for each sub-pixel, and the stress data may include sub stress data for each sub-pixel which includes sub-pixel degradation information. The scaling rate calculator may select maximum sub-pixel degradation information from a maximum value of the sub stress data and may calculate sub scaling rate of the sub image data based on the maximum sub-pixel degradation information. The image processor may decrease a maximum grayscale value of the sub image data based on the sub scaling rate.

In exemplary embodiments, the scaling rate calculator may periodically calculate the scaling rate with a first period, may store the scaling rate in a memory component, and may update the scaling rate stored in the memory component.

In exemplary embodiments, the application processor may further include a stress calculator that generates the pixel degradation information by accumulating input grayscale values of the first image data for each pixel.

According to exemplary embodiments, a display device includes a display panel that includes a pixel; an application processor that determines a scaling rate of first image data based on stress data that includes pixel degradation information and generates second image data by decreasing a maximum grayscale value of the first image data based on the scaling rate, the first image data being received from an external component; a timing controller that generates third image data by compensating the second image data based on the pixel degradation information; and a data driver that generates a data voltage based on the third image data and transmits the data voltage to the pixel.

In exemplary embodiments, the application processor may calculate the scaling rate of the first image data based on the pixel degradation information and a look-up table, where the look-up table includes the scaling rate, where the scaling rate is predetermined based on the pixel degradation information.

In exemplary embodiments, the application processor may select maximum pixel degradation information from a maximum stress data value and may calculate the scaling rated of the first image data based on the maximum pixel degradation information.

In exemplary embodiments, the look-up table may further include a compensation grayscale value that is calculated based on an input grayscale value of the first image data and the pixel degradation information. The timing controller may generate the third image data based on the pixel degradation information, the second image data, and the look-up table.

In exemplary embodiments, the pixel may include sub-pixels, the image data may include sub image data for each of the sub-pixels, and the stress data may include sub stress data for each of the sub-pixels which includes sub-pixel degradation information. The application processor may select maximum sub-pixel degradation information from a maximum sub stress data value and may calculate sub scaling rate of the sub image data based on the maximum sub-pixel degradation information.

According to exemplary embodiments, an application processor includes a scaling rate calculator that determines a scaling rate of first image data based on stress data that includes pixel degradation information for each pixel, the first image data being received from an external component. The scaling rate calculator calculates the scaling rate of the first image data based on the pixel degradation information and a look-up table that includes a compensation grayscale value which is calculated based on an input grayscale value of the first image data and the pixel degradation information.

In exemplary embodiments, the application processor may further include an image processor that may generate second image data by decreasing a maximum grayscale value of the first image data based on the scaling rate; and a stress calculator that may generate the pixel degradation information by accumulating input grayscale values of the first image data for each pixel.

In exemplary embodiments, the look-up table may include the scaling rate, and the scaling rate may be predetermined based on the pixel degradation information. The scaling rate may be greater than or equal to a ratio of the input grayscale value to the compensation grayscale value, and the compensation grayscale value may be equal to a maximum grayscale value that is usable in the second image data.

In exemplary embodiments, the scaling rate calculator may select maximum pixel degradation information from a maximum stress data value, and may calculate the scaling rate of the first image data based on the maximum pixel degradation information.

Therefore, an application processor according to exemplary embodiments can ensure a compensation margin, such as a margin of grayscale values for compensating the pixel degradation, by determining a scaling rate of first image data received form an external component based on stress data that includes pixel degradation information for each pixel and by decreasing the maximum grayscale value of the first image data based on the scaling rate.

In addition, an application processor according to exemplary embodiments can ensure a compensation margin for all pixels to be compensated by determining the scaling rate of the first image data based on the maximum pixel degradation information selected from a maximum value of the stress data.

Furthermore, an application processor according to exemplary embodiments can ensure an optimized compensation margin by using a scaling rate that is based on an input grayscale that corresponds to a time point at which a compensation grayscale value, or, a compensated grayscale value, is saturated or at which the compensation grayscale value has a maximum grayscale value.

A display device according to exemplary embodiments can compensate pixel degradation with a sufficient compensation margin by including an application processor.

BRIEF DESCRIPTION OF THE DRAWINGS

FIG. 3 illustrates an example of a look-up table used by an application processor of FIG. 2.

FIG. 6A illustrates an example of an algorithm for calculating a scaling rate by an application processor of FIG. 2.

DETAILED DESCRIPTION OF EXEMPLARY EMBODIMENTS

Hereinafter, exemplary embodiments of the present inventive concept will be explained in detail with reference to the accompanying drawings.

Figure 1:
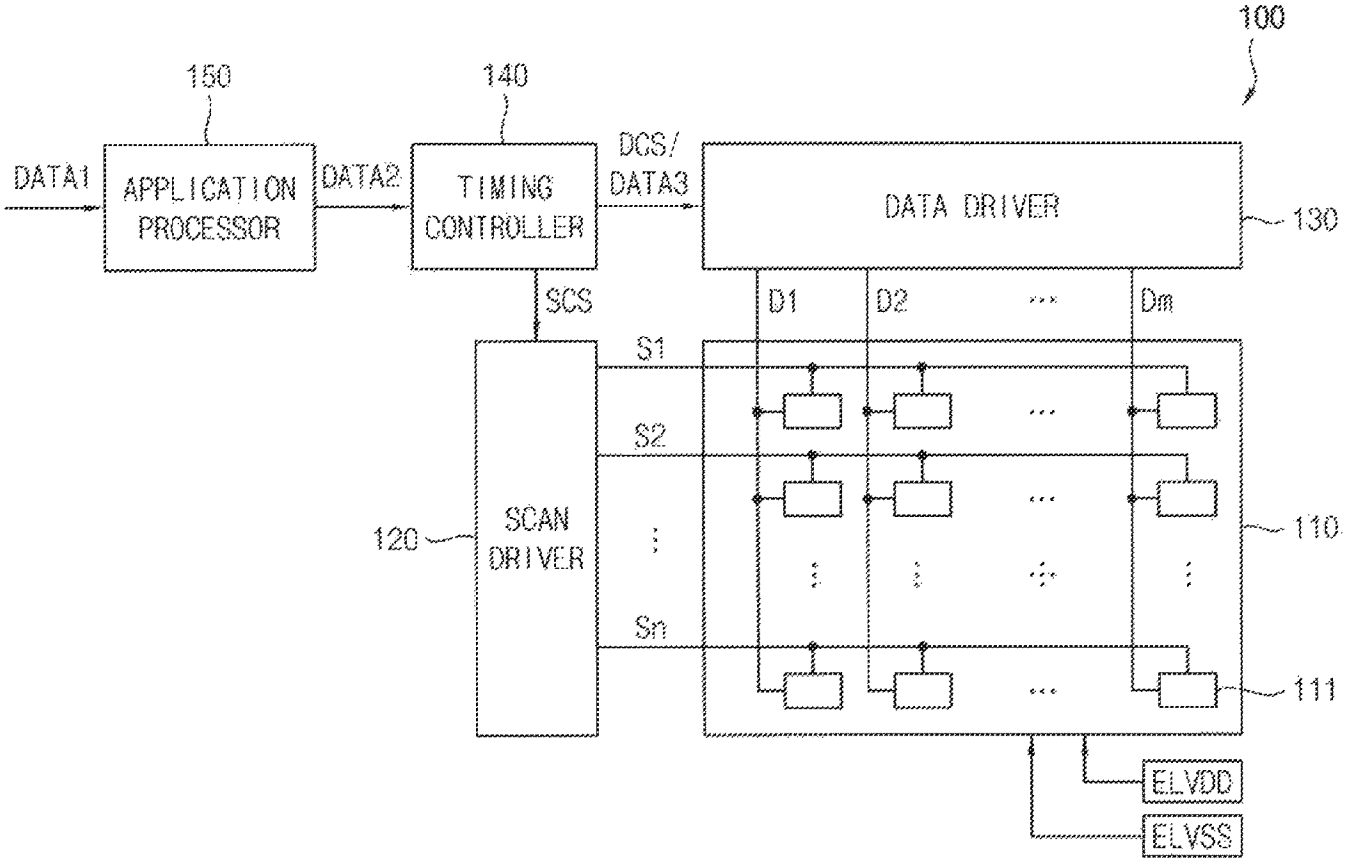
FIG. 1 is a block diagram of a display device according to exemplary embodiments.

FIG. 1 is a block diagram of a display device according to exemplary embodiments.

Referring to FIG. 1, a display device 100 includes a display panel 110, a scan driver 120, a data driver 130, a timing controller 140, and an application processor 150. The display device 100 displays an image based on image data, such as first image data DATA1, received from an external component. The display device 100 may be an organic light emitting display device.

According to exemplary embodiments, the display panel 110 includes gate lines S1 through Sn, data lines D1 through Dm, and pixels 111, where n and m are each an integer greater than or equal to 2. The pixels 111 are disposed in cross-regions of the gate lines S1 through Sn and the data lines D1 through Dm, respectively. Each of the pixels 111 can store a data signal, such as a data signal received from the data lines D1 through Dm, in response to a gate signal, such as a gate signal received from the gate lines S1 through Sn, and can emit light based on the stored data signal.

In some exemplary embodiments, the pixels 111 include sub-pixels. For example, the pixels 111 may include a first sub-pixel emitting light with a first color, such as red, a second sub-pixel emitting light with a second color, such as green, and a third sub-pixel emitting light with a third color, such as blue.

According to exemplary embodiments, the scan driver 120 generates a gate signal based on a gate driving control signal SCS received from the timing controller 140. The gate driving control signal SCS includes a start signal or start pulse, and clock signals, and the scan driver 120 includes shift registers that sequentially generate the gate signal based on the start signal and the clock signals.

According to exemplary embodiments, the data driver 130 generates the data signal based on a third image data DATA3 received from the timing controller 140. The data driver 130 transmits to the display panel 110 a data signal generated in response to a data driving control signal DCS received from the timing controller 140.

According to exemplary embodiments, the timing controller 140 controls the scan driver 120 and the data driver 130. The timing controller 140 generates the scan driving control signal SCS and the data driving control signal DCS and controls the scan driver 120 and the data driver 130 based on the generated signals.

According to exemplary embodiments, the timing controller 140 generates third image data DATA3 by compensating second image data DATA2 received from the application processor based on pixel degradation information. According to embodiments, the pixel degradation information represents an amount of pixel degradation, such as a degree of pixel degradation or a reduction ratio of light emitting performance of the pixel. For example, the timing controller 140 may calculate the pixel degradation information based on a temperature of the display panel 110, accumulated grayscale values for each pixel, a frame rate of the display device 100, etc.

In some exemplary embodiments, the pixel degradation information is calculated based on the image data, such as the first image data DATA1 or the second image data DATA2, received from the external component. For example, the timing controller 140 or the application processor 150 can calculate pixel degradation information by accumulating an input grayscale value of the second image data DATA2 or the first image data DATA1 for each pixel. The pixel degradation information can be stored in a memory device and be updated periodically.

In some exemplary embodiments, the pixel degradation information is calculated based on a sensing current. For example, the display device 100 can provide a reference voltage or a sensing voltage to the pixels 111 and generate the sensing current by measuring a current flowing through the pixels 111. According to an embodiment, the display device 100 can calculate the pixel degradation information based on the sensing current and a reference current corresponding to the reference voltage. For example, when the pixels 111 are degraded, the sensing current is less than the reference current, and the pixel degradation information is calculated based on a difference between the reference current and the sensing current.

In some exemplary embodiments, the timing controller 140 generates the third image data DATA3 based on the pixel degradation information, the second image data DATA2, and a look-up table. According to an embodiment, the look-up table includes a compensation grayscale value which is calculated based on an input grayscale value of the second image data DATA2 and the pixel degradation information. The look-up table will be described in detail with reference to FIG. 3.

According to exemplary embodiments, the application processor 150 determines a scaling rate of the first image data DATA1 based on stress data that includes pixel degradation information for each pixel and generate the second image data DATA2 by decreasing the maximum grayscale value of the first image data DATA1 based on the scaling rate. According to embodiments, the first image data DATA1 is received from an external component, and the stress data is received from the timing controller 140 or generated by the application processor 150. The application processor 150 can ensure a compensation margin, i.e., a margin for compensating the pixel degradation, by decreasing the maximum grayscale value of the first image data DATA1 based on the stress data.

In some exemplary embodiments, the application processor 150 calculates the scaling rate of the first image data DATA1 based on the pixel degradation information and the look-up table. According to an embodiment, the look-up table includes a scaling rate which is predetermined based on the pixel degradation information, or a value equivalent to the pixel degradation information. For example, the look-up table can represent the relationship between the pixel degradation information and the scaling rate.

In some exemplary embodiments, the application processor 150 selects a maximum pixel degradation information based on a maximum stress data value and calculates the scaling rate of the first image data DATA1 based on the maximum pixel degradation information. For reference, as an amount of pixel degradation represented by the pixel degradation information increases, a compensation grayscale value of compensation data also increases. Therefore, a scaling rate calculated based on the maximum pixel degradation information can have a minimum value or a value less than a scaling rate value that is calculated based on other pixel degradation information. According to an embodiment, the second image data DATA2, which is generated based on the scaling rate, may have a sufficient compensation margin to compensate the pixel degradation of all the pixels 111.

In some exemplary embodiments, the application processor 150 includes an initial scaling rate and sets the scaling rate to be equal to the initial rate when the initial scaling rate is less than the scaling rate. According to an embodiment, the initial scaling rate can be predetermined. That is, the application processor 150 ensures the compensation margin to be greater than a predetermined magnitude by selecting which of the initial scaling rate and the scaling rate that has a smaller value.

As described above, the display device 100 according to exemplary embodiments can ensure a compensation margin, such as a margin of grayscale values that can compensate pixel degradation, by determining a scaling rate of the first image data DATA1 based on a stress data that includes the pixel degradation information for each pixel and by decreasing the maximum grayscale value of the first image data DATA1 based on the scaling rate.

Figure 2:
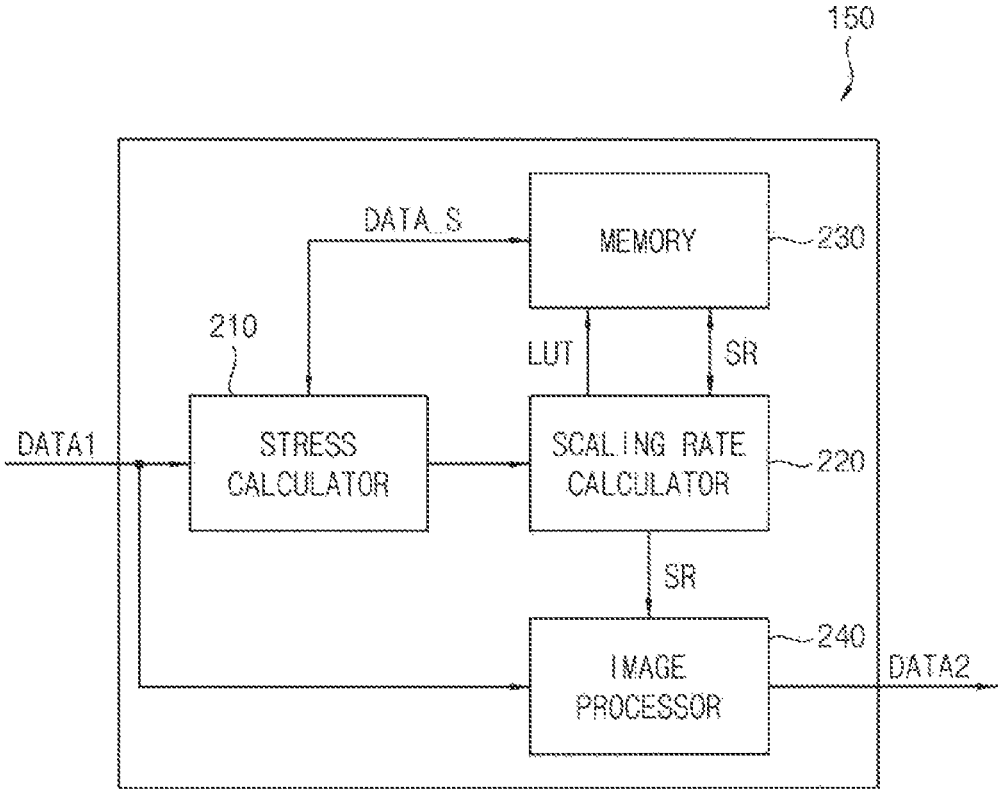
FIG. 2 is a block diagram of an example of an application processor included in the display device of FIG. 1.

FIG. 2 is a block diagram of an example of an application processor included in a display device of FIG. 1.

Referring to FIG. 2, according to an embodiments, the application processor 150 include a stress calculator 210, a scaling rate calculator 220, a memory device or component 230, and an image processor 240.

According to exemplary embodiments, the stress calculator 210 generates stress data DATA_S that includes the pixel degradation information. In an exemplary embodiment, the stress calculator 210 generates the pixel degradation information by accumulating an input grayscale value for each pixel, where the input grayscale value is included in the first image data DATA1. For example, the stress calculator 210 generates an accumulated grayscale value by periodically accumulating the input grayscale value from a time in which the display device 100 is initially driven to a current time, e.g., with a period of four hours, and generates the pixel degradation information proportional to the accumulated grayscale value. According to an embodiment, the accumulated grayscale value or the stress data DATA_S that includes the accumulated grayscale value is stored in the memory device 230 and can be periodically loaded or updated.

In an exemplary embodiment, the stress calculator 210 obtains or receives the pixel degradation information from an external component. For example, the stress calculator 210 obtains the pixel degradation information from the timing controller 140.

According to exemplary embodiments, the scaling rate calculator 220 determines the scaling rate SR of the first image data DATA1 based on the stress data DATA_S.

In some exemplary embodiments, the scaling rate calculator 220 calculates the scaling rate SR of the first image data DATA1 based on the pixel degradation information and a look-up table. According to an embodiment, the pixel degradation information is included in the stress data DATA_S, and the look-up table may include the scaling rate or may represent a relationship between the pixel degradation information and the scaling rate.

FIG. 3 illustrates an example of a look-up table used by an application processor of FIG. 2.

Referring to FIG. 3, according to exemplary embodiments, the look-up table 300 includes the scaling rate SR_ISC and a compensation grayscale value. According to an embodiment, the scaling rate SR_ISC is predetermined based on the pixel degradation information AGE, and the compensation grayscale values are predetermined based on an input grayscale value INPUT GRAY and the pixel degradation information AGE. The input grayscale values INPUT GRAY may be included in the first image data DATA1 or the second image data DATA2 and are equal to a maximum grayscale value.

As illustrated in FIG. 3, according to exemplary embodiments, the input grayscale value INPUT GRAY increases along a vertical direction in the look-up table 300. For example, the input grayscale value INPUT GRAY is within a predetermined range based on a number of data bits. For example, when there are 8 data bits, the input grayscale value INPUT GRAY are in a range of 0 through 255, or in a range of 0 through 256 if there are 9 bits. When there are 13 data bits, the input grayscale value INPUT GRAY is in a range of 0 through 8160, or in a range of 0 through 8192 if there are 14 bits.

According to exemplary embodiments, the pixel degradation information AGE is in a range of 1 through 1023. The pixel degradation information AGE is illustrated as an example in FIG. 3. The pixel degradation information AGE is not limited thereto in other embodiments.

According to exemplary embodiments, the compensation grayscale value or output grayscale value corresponds to the input grayscale value INPUT GRAY and the pixel degradation information AGE and can be obtained through repeated experiments. The compensation grayscale value may be represented with 13 bits.

As illustrated in FIG. 3, according to exemplary embodiments, as the pixel degradation information AGE increases, compensation grayscale values increase. For example, when the pixel degradation information AGE has a value of 1, a compensation grayscale value that corresponds to an input grayscale value INPUT of 8192 has a value of 8192. For example, when the pixel degradation information AGE has a value of 5 and the input grayscale value INPUT GRAY corresponding to a maximum grayscale value has a value of 8064, the compensation grayscale value is 8192, and input grayscale values INPUT GRAY greater than 8064 are compensated by a compensation grayscale value of 8192, depending on the pixel degradation information AGE, due to limitations of the range of grayscale values. That is, an input grayscale value INPUT GRAY greater than 8064, may not be compensated exactly or correctly. Therefore, when the pixel degradation information AGE has a value of 5, the display device 100 according to exemplary embodiments prevents the compensation grayscale values from exceeding a maximum value of 8192, or to be less than a maximum value of 8192, by reducing a range of the input grayscale value INPUT GRAY included in the first image data DATA1 to be less than or to be equal to a range of 0 through 8064, i.e., by decreasing the maximum grayscale value of the first image data DATA1.

In some exemplary embodiments, the scaling rate SR_ISC is less than or equal to a ratio of the input grayscale value INPUT GRAY to the compensation grayscale value. For example, when the pixel degradation information AGE has a value of 5 and the input grayscale value INPUT GRAY has a value of 8064, the corresponding compensation grayscale value has a value of 8192. According to an embodiment, the scaling rate SR_ISC is 0.984 (e.g., 8064/8192).

Referring again to FIG. 2, according to exemplary embodiments, the scaling rate calculator 220 selects a maximum pixel degradation information from a greatest stress data value and calculates the scaling rate of the first image data DATA1 based on the maximum pixel degradation information. For example, when the stress data includes values in a range of 1 through 5, the scaling rate calculator 220 selects the value 5 as the greatest of the values 1 through 5 and calculates the scaling rate SR corresponding to the maximum pixel degradation information.

In some exemplary embodiments, the scaling rate calculator 220 includes an initial scaling rate and compensates the scaling rate SR to be equal to the initial rate when the initial scaling rate is less than the scaling rate. According to an embodiment, the initial scaling rate is predetermined. For example, when a maximum luminance of the display device 100 or the pixels 111 is 600 nits, a desired or an initial luminance of the display device 100 is 500 nits, and the gamma is 2.2, the initial scaling rate is 0.921, i.e., the maximum luminance of 600 nits$\times 0.921^{2.2}$=the desired luminance of 500 nits. According to an embodiment, the display device 100 compensates the pixel degradation while maintaining the desired luminance, i.e., 500 nits, by using the initial scaling rate when the scaling rate SR is greater than the initial scaling rate. On the other hand, the display device 100 compensates pixel degradation by reducing luminance using the scaling rate SR when the scaling rate SR is less than the initial scaling rate.

According to exemplary embodiments, the memory device 230 stores the stress data DATA_S, the look-up table LUT and the scaling rate SR. The memory device 230 provides the stress data DATA_S to the stress calculator 210 in response to a request from the stress calculator 210 and restores the stress data DATA_S, which is periodically updated or regenerated by the stress calculator 210. Similarly, the memory device 230 provides the look-up table LUT and the scaling rate SR to the scaling rate calculator 220 in response to a request from the scaling rate calculator 220. The scaling rate SR is periodically updated and stored. When the display device 100 is driven, i.e., in a power-on state, the application processor 150 minimizes changes of image data, such as the second image data DATA2, by using the pre-stored scaling rate SR.

According to exemplary embodiments, the image processor 240 generates the second image data DATA2 by decreasing the maximum grayscale values of the first image data DATA1 based on the scaling rate SR. The image processor 240 ensures a compensation margin for compensating the pixel degradation by decreasing the maximum grayscale values of the first image data DATA1.

As described above, an application processor according to exemplary embodiments can ensure a compensation margin for compensating pixel degradation by determining the scaling rate SR of the first image data DATA1 based on stress data DATA_S that includes pixel degradation information for each pixel and by decreasing the maximum grayscale values of the first image data DATA1 based on the scaling rate SR.

Figure 4A:
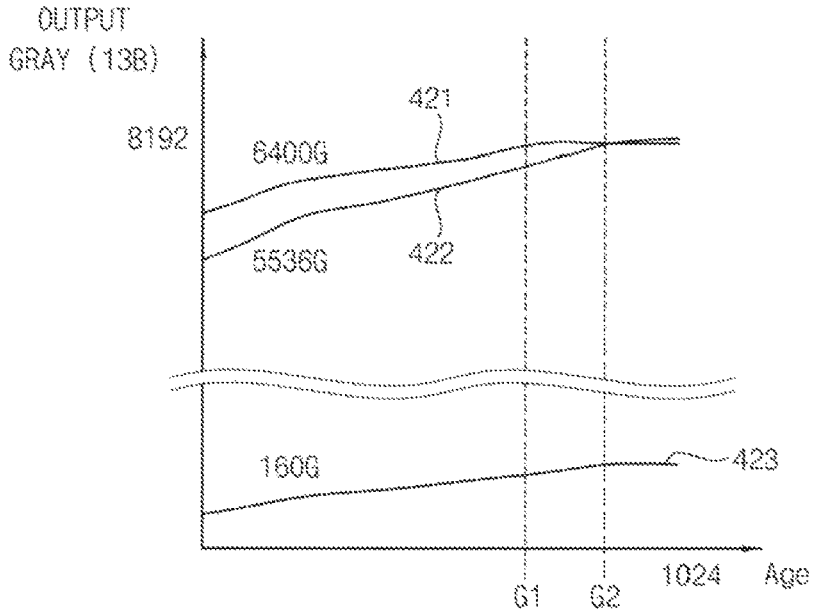
FIG. 4A illustrates an example of an input grayscale value compensated based on a look-up table of FIG. 3.
Figure 4B:
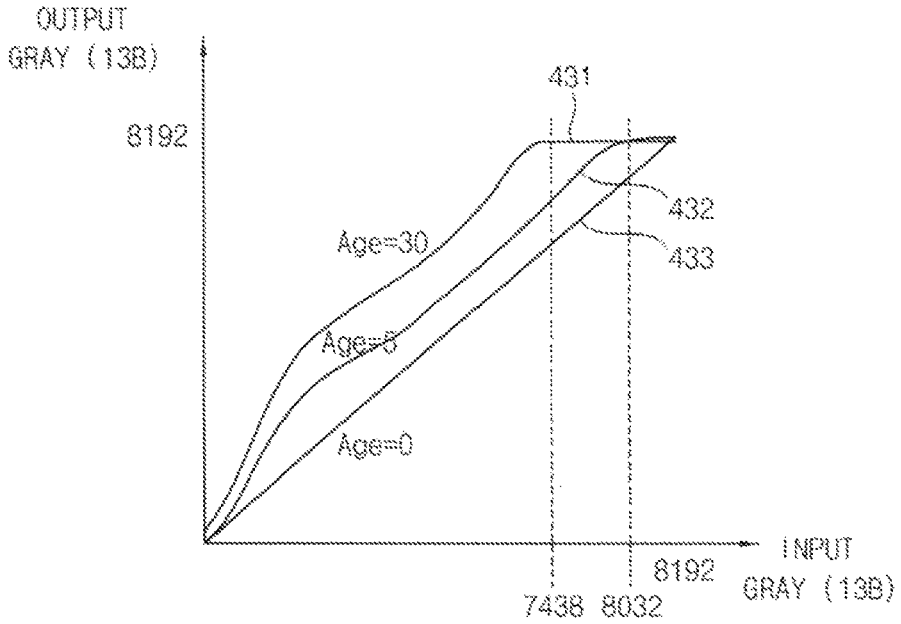
FIG. 4B illustrates another example of an input grayscale value compensated based on a look-up table of FIG. 3.

FIG. 4A illustrates an example of an input grayscale value compensated based on a look-up table of FIG. 3. FIG. 4B m illustrates another example of an input grayscale value compensated based on a look-up table of FIG. 3.

Referring to FIGS. 3 and 4A, the horizontal axis represents the pixel degradation information AGE, and the vertical axis represents the compensation grayscale value OUTPUT GRAY. According to an embodiment, the compensation grayscale value may be generated based on a pixel grayscale value to emit light with a desired luminance. In addition, the compensation grayscale value may be represented in a data format of 13 bits.

A first compensation grayscale curve 421 represents a compensation grayscale value OUTPUT GRAY that corresponds to a first grayscale value of 6400 as a function of the pixel degradation information. In the first compensation grayscale curve 421, the compensation grayscale value OUTPUT GRAY increases as the pixel degradation information AGE increases, and the rate of change of the compensation grayscale value OUTPUT GRAY with respect to the pixel degradation information AGE can be non-linear. In the first compensation grayscale curve 421, the compensation grayscale value OUTPUT GRAY has a maximum grayscale value of 8192 when the pixel degradation information AGE has a value that is greater than or equal to a first degradation value G1. That is, the first compensation grayscale values OUTPUT GRAY for the first grayscale value 6400 saturates when the pixel degradation information AGE reaches the first degradation value G1, and does not increase as the pixel degradation information AGE increases.

Similarly, a second compensation grayscale curve 422 represents a compensation grayscale value OUTPUT GRAY that corresponds to a second grayscale value 5536 as a function of the pixel degradation information. In the second compensation grayscale curve 422, the compensation grayscale value OUTPUT GRAY increases as the pixel degradation information AGE increases. In the second compensation grayscale curve 422, the compensation grayscale value OUTPUT GRAY has a maximum grayscale value of 8192 when the pixel degradation AGE information reaches a second degradation value G2. According to an embodiment, the second degradation value G2 is greater than the first degradation value G1. That is, the second compensation grayscale value OUTPUT GRAY for the second grayscale value of 5536 saturates after the first compensation grayscale value OUTPUT GRAY for the first grayscale value of 8600 saturates.

A third compensation grayscale curve 423 represents a compensation grayscale value OUTPUT GRAY that corresponds to a third grayscale value 160 as a function of the pixel degradation information. In the third compensation grayscale curve 423, the compensation grayscale value OUTPUT GRAY does not saturate.

For example, when the first image data DATA1 illustrated in FIG. 2 includes the first grayscale value 6400, the second grayscale value 5536, and the third grayscale value 160, the application processor 150 of the display device 100 sets the compensation margin for compensating pixel degradation based on the input grayscale INPUT GRAY, i.e., the first though third grayscale values 6400, 5536, and 160. According to an embodiment, a configuration for setting the compensation margin can be complex because a compensation margin is set for each input grayscale value.

Referring to FIGS. 3 and 4B, the horizontal axis represents the input grayscale values INPUT GRAY, and the vertical axis represents the compensation grayscale values OUTPUT GRAY.

A fourth compensation grayscale curve 431 represents a compensation grayscale value OUTPUT GRAY as a function of the input grayscale values INPUT GRAY when the pixel degradation information AGE has a value of 30. In the fourth compensation grayscale curve 431, the compensation grayscale value OUTPUT GRAY increase as the input grayscale value INPUT GRAY increases, and the rate of change of the compensation grayscale value OUTPUT GRAY with respect to the input grayscale value INPUT GRAY is non-linear. In the fourth compensation grayscale curve 431, the compensation grayscale value OUTPUT GRAY saturates when the input grayscale value INPUT GRAY has a fourth grayscale value of 7438.

Similarly, a fifth compensation grayscale curve 432 represents a compensation grayscale value OUTPUT GRAY as a function of the input grayscale value INPUT GRAY when the pixel degradation information AGE has a value of 5. In the fifth compensation grayscale curve 432, the compensation grayscale value OUTPUT GRAY saturates when the input grayscale value INPUT GRAY has a fifth grayscale value of 8032.

A sixth compensation grayscale curve 433 represents a compensation grayscale value OUTPUT GRAY as a function of the input grayscale value INPUT GRAY when the pixel degradation information AGE has a value of 0. In the sixth compensation grayscale curve 433, the compensation grayscale value OUTPUT GRAY does not saturate.

As illustrated in FIG. 4B, as the pixel degradation information AGE increases, the saturation value for the compensation grayscale value decreases. That is, as the pixel degradation information AGE increases, a valid range of the input grayscale values INPUT GRAY for the compensation grayscale value OUTPUT GRAY becomes narrower.

Therefore, an application processor 150 of a display device according to exemplary embodiments sets the compensation margin based on the pixel degradation information AGE. That is, the display device 100 sets the compensation margin based on the maximum pixel degradation information. For example, the display device 100 sets an optimized compensation margin for all pixels to be compensated by decreasing the maximum grayscale values of the first image data DATA1 to be within a range of the input grayscale value INPUT GRAY for which the maximum compensation grayscale value OUTPUT GRAY does not saturate.

Figure 5:
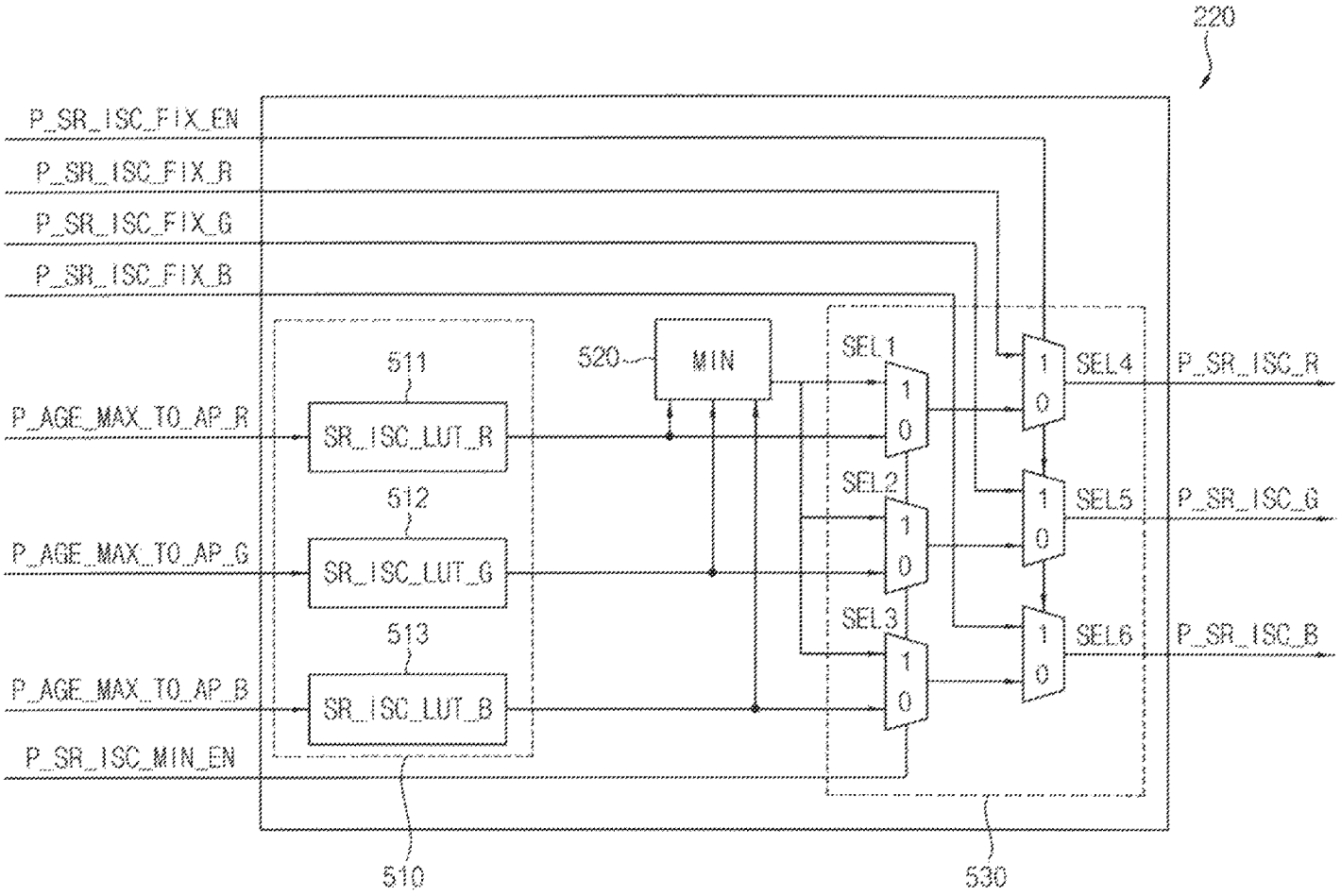
FIG. 5 illustrates an example of a scaling rate calculator included in an application processor of FIG. 2.

FIG. 5 illustrates an example of a scaling rate calculator included in an application processor of FIG. 2.

According to exemplary embodiments, as described with reference to FIG. 1, the pixels 111 include sub-pixels. According to an embodiment, image data, such as the first image data DATA1 or the second image data DATA2, etc., include data for each of the sub-pixels, and the stress data DATA_S may include sub-pixel degradation information for each of the sub-pixels.

Referring to FIGS. 2 and 5, according to exemplary embodiments, the scaling rate calculator 220 includes a sub scaling rate calculator 510, a minimum value calculator 520, and a selector 530. The scaling rate calculator 220 calculates sub scaling rates P_SR_ISC_R, P_SR_ISC_, and P_SR_ISC_B for sub-pixels.

According to exemplary embodiments, the sub scaling rate calculator 510 calculates the sub scaling rate based on a maximum sub-pixel degradation information value selected from the sub stress data. For example, the sub scaling rate calculator 510 selects a first maximum sub-pixel degradation information P_AGE_MAX_TO_AP_R from a maximum value of the first sub-pixel degradation information for first pixels, such as pixels that emit red light, and calculates the first sub scaling rate using a first sub look-up table SR_ISC_LUT_R 511. According to an embodiment, the first sub look-up table SR_ISC_LUT_R 511 is substantially the same as the look-up table 300 described with reference to FIG. 3.

Similarly, according to exemplary embodiments, the sub scaling rate calculator 510 selects a second maximum sub-pixel degradation information P_AGE_MAX_TO_AP_G from a maximum value of the second sub-pixel degradation information for second pixels, such as pixels that emit green light, and calculate the second sub scaling rate using a second sub look-up table SR_ISC_LUT_G 512. In addition, the sub scaling rate calculator 510 selects a third maximum sub-pixel degradation information P_AGE_MAX_TO_AP_B from a maximum value of the third sub-pixel degradation information for third pixels, such as pixels that emit blue light, and calculate the third sub scaling rate using a third sub look-up table SR_ISC_LUT_B 513.

According to exemplary embodiments, the minimum value calculator 520 calculates or selects a minimum value from output values of the sub scaling rate calculator 510. For example, the minimum value calculator 520 selects a smallest sub scaling rate from the first through third sub scaling rates.

According to exemplary embodiments, the selector 530 selects and outputs at least one of the first through third sub scaling rates output from the sub scaling rate calculator 510, the minimum sub scaling rate calculated by the minimum value calculator 520, and initial sub scaling rates P_SR_ISC_FIX_R, P_SR_ISC_FIX_G, and P_SR_ISC_FIX_B based on an initial sub scaling rate selection signal P_SR_ISC_FIX_EN and a minimum sub scaling rate selection signal P_SR_ISC_MIN_EN. According to an embodiment, each of the initial sub scaling rates P_SR_ISC_FIX_R, P_SR_ISC_FIX_G, and P_SR_ISC_FIX_B are substantially the same as the initial scaling rate described with reference to FIG. 2 and are predetermined.

According to exemplary embodiments, as illustrated in FIG. 5, the selector 530 includes first through sixth selecting units or sub selectors SEL1 through SEL6. Each of the first through sixth selecting units SEL1 through SEL6 can be implemented as a multiplexer.

According to exemplary embodiments, the first selecting unit SEL1 receives the first sub scaling rate and the minimum sub scaling rate and outputs one of the first sub scaling rate and the minimum sub scaling rate based on the minimum sub scaling rate selection signal P_SR_ISC_MIN_EN. Similarly, the second selecting unit SEL2 receives the second sub scaling rate and the minimum sub scaling rate and outputs one of the second sub scaling rate and the minimum sub scaling rate based on the minimum sub scaling rate selection signal P_SR_ISC_MIN_EN. The third selecting unit SEL3 receives the third sub scaling rate and the minimum sub scaling rate and outputs one of the third sub scaling rate and the minimum sub scaling rate based on the minimum sub scaling rate selection signal P_SR_ISC_MIN_EN.

For example, when the minimum sub scaling rate selection signal P_SR_ISC_MIN_EN has a logic low level, the first selecting unit SEL1 selects the first sub scaling rate, the second selecting unit SEL2 selects the second sub scaling rate, and the third selecting unit SEL3 selects the third sub scaling rate. For example, when the minimum sub scaling rate selection signal P_SR_ISC_MIN_EN has a logic high level, the first selecting unit SEL1, the second selecting unit SEL2, and the third selecting unit SEL3 select the minimum sub scaling rate, respectively.

According to exemplary embodiments, the fourth selecting unit SEL4 receives an output of the first selecting unit SEL1 and the first initial sub scaling rate P_SR_ISC_FIX_R and outputs one of the output of the first selecting unit SEL1 and the first initial sub scaling rate P_SR_ISC_FIX_R based on the initial sub scaling rate selection signal P_SR_ISC_FIX_EN. Similarly, the fifth selecting unit SEL5 receives an output of the second selecting unit SEL2 and the second initial sub scaling rate P_SR_ISC_FIX_G and outputs one of the output of the second selecting unit SEL2 and the second initial sub scaling rate P_SR_ISC_FIX_G based on the initial sub scaling rate selection signal P_SR_ISC_FIX_EN. The sixth selecting unit SEL6 receives an output of the third selecting unit SEL3 and the third initial sub scaling rate P_SR_ISC_FIX_B and outputs one of the output of the third selecting unit SEL3 and the third initial sub scaling rate P_SR_ISC_FIX_B based on the initial sub scaling rate selection signal P_SR_ISC_FIX_EN.

For example, when the initial sub scaling rate selection signal P_SR_ISC_FIX_EN has a logic low level, the fourth selecting unit SEL4 selects the output of the first selecting unit SEL1, the fifth selecting unit SEL5 selects the output of the second selecting unit SEL2, and the sixth selecting unit SEL6 selects the output of the third selecting unit SEL3. For example, when the initial sub scaling rate selection signal P_SR_ISC_FIX_EN has a logic high level, the fourth selecting unit SEL4 select the first initial sub scaling rate P_SR_ISC_FIX_R, the fifth selecting unit SEL5 selects the second initial sub scaling rate P_SR_ISC_FIX_G, and the sixth selecting unit SEL6 selects the third initial sub scaling rate P_SR_ISC_FIX_B.

That is, according to exemplary embodiments, the scaling rate calculator 220 selects the maximum sub-pixel degradation information from a maximum value of the stress data DATA_S and calculates or outputs a sub scaling rate corresponding to the maximum sub-pixel degradation information. In addition, the scaling rate calculator 220 selects the maximum sub-pixel degradation information from a maximum value of the sub stress data and calculates or outputs a sub scaling rate for sub image data based on the maximum sub-pixel degradation information.

According to exemplary embodiments, as described with reference to FIG. 5, the scaling rate calculator 220 calculate a scaling rate or sub scaling rates for each of sub-pixels, or for each sub stress data for each sub image.

Figure 6B:
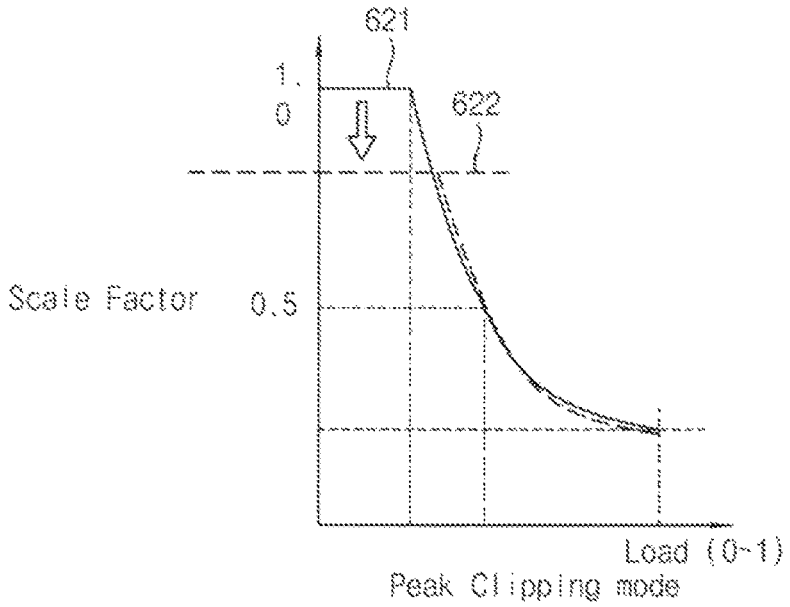
FIGS. 6B and 6C illustrate examples of a scaling rate calculated based on an algorithm of FIG. 6A.
Figure 6C:
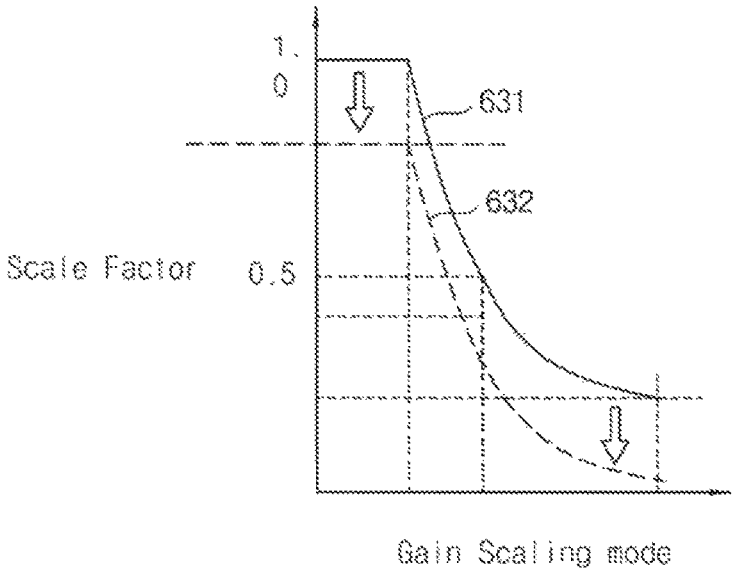

FIG. 6A illustrates an example of an algorithm for calculating a scaling rate by the application processor of FIG. 2. FIGS. 6B and 6C illustrating examples of a scaling rate calculated based on an algorithm of FIG. 6A.

Referring to FIGS. 2 and 6 through 6C, according to exemplary embodiments, the scaling rate calculator 220 of the application processor 150 compensates the scaling rate SR_ISC based on a current-limit-scaling rate SRdeault. According to an embodiment, the current-limit-scaling rate SRdeault is a reduction ratio of the first image data DATA1 calculated based on an on-pixel ratio of the first image data DATA1. According to an embodiment, the on-pixel ratio is a ratio of a number of activated pixels, i.e., a number of pixels that are activated or turned on based on the first image data DATA1, to a total number of pixels included in the display panel 110. For example, the on-pixel ratio is a ratio of current flowing through the pixels 11 based on the first image data DATA1 to a maximum current flowing through the pixels 111 based on a maximum grayscale value. Generally, the display device 10 reduces power consumption of the display device 100 by decreasing the maximum grayscale values of the first image data DATA1 using the current-limit-scaling rate SRdeault.

According to exemplary embodiments, as illustrated in FIG. 6A, the application processor 150 compares the current-limit-scaling rate SRdeault and the scaling rate SR_ISC and selects one of the current-limit-scaling rate SRdeault and the scaling rate SR_ISC based on a comparison result. In addition, the application processor 150 compensates the scaling rate SR_ISC in proportion to the current-limit-scaling rate SRdeault based on the comparison result. For example, the application processor 150 outputs a product of the current-limit-scaling rate SRdeault and the scaling rate SR_ISC.

Referring to FIGS. 6B and 6C, according to exemplary embodiments, a horizontal axis represents a load of the display panel 110, and a vertical axis represents a scaling rate Scale Factor. According to an embodiment, the load of the display panel 110 represents the on-pixel ratio of the first image data DATA1 or the pixel degradation information expressed in percentages. The scaling rate Scale Factor represents the scaling rate SR_ISC calculated by the scaling rate calculator 220, or the current-limit-scaling rate SRdefuault.

According to exemplary embodiments a first scaling rate curve 621 represents a change of the scaling rate SR_ISC as a function of a change of the load, and a second scaling rate curve 622 represents a compensated scaling rate based on the current-limit-scaling rate SRdefault. According to an embodiment, the compensated scaling rate has a value equal to a value of the current-limit-scaling value SRdefault when the current-limit-scaling rate SRdefault is less than the scaling rate SR_ISC.

That is, according to exemplary embodiments, the application processor 150 selects the lesser of the scaling rate SR_ISC and the current-limit-scaling value SRdefault so that the display device 100 can be driven with a power consumption below a certain value.

Referring to FIG. 6C, according to exemplary embodiments, a third scaling rate curve 631 represents a change of the scaling rate SR_ISC as a function of the load, and a fourth scaling rate curve 632 represents a compensated scaling rate based on the current-limit-scaling rate SRdefault. According to an embodiment, the compensated scaling rate is compensated proportionally to the current-limit-scaling value SRdefault.

That is, according to exemplary embodiments, the application processor 150 multiplies the scaling rate SR_ISC and the current-limit-scaling rate SRdefault so that the display device 100 can be driven with a decreased power consumption.

Embodiments of the present inventive concept can be incorporated into any display device, such as an organic light emitting display device, a liquid crystal display device, etc. For example, embodiments of the present inventive concept can be incorporated into a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of exemplary embodiments, and is not to be construed as limiting thereof. Although a few exemplary embodiments have been described, those skilled in the art will readily appreciate that many modifications are possible in the exemplary embodiments without materially departing from the novel teachings and advantages of exemplary embodiments. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. Embodiments of the inventive concept are defined by the following claims, with equivalents of the claims to be included therein.

What is claimed is:

1. An application processor comprising:

a scaling rate calculator that determines a scaling rate of first image data based on stress data that includes pixel degradation information for each pixel, wherein the first image data is received from an external component; and an image processor that generates second image data by decreasing a maximum grayscale value of the first image data based on the scaling rate.

2. The application processor of claim 1, wherein the scaling rate calculator calculates the scaling rate of the first image data based on the pixel degradation information and a look-up table, and wherein the look-up table includes the scaling rate, and the scaling rate is predetermined based on the pixel degradation information.

3. The application processor of claim 2, wherein the lookup table further includes a compensation grayscale value which is calculated based on an input grayscale value of the first image data and the pixel degradation information, and wherein the scaling rate is greater than or equal to a ratio of the input grayscale value to the compensation grayscale value, wherein the compensation grayscale value is equal to a maximum grayscale value that is usable in the second image data.

4. The application processor of claim 2, wherein the sealing rate calculator selects maximum pixel degradation information from a maximum stress data value, and calculates the scaling rate of the first image data based on the maximum pixel degradation information.

5. The application processor of claim 4, wherein the scaling rate calculator compares the scaling rate and an initial scaling rate and compensates the scaling rate to be equal to the initial scaling rate when the initial scaling rate is less than the scaling rate.

6. The application processor of claim 4, wherein the scaling rate calculator compensates the scaling rate based on a current-limit-scaling rate, and wherein the current-limit-scaling rate is a reduction ratio of the first image data that is calculated based on an on-pixel ratio of the first image data.

7. The application processor of claim 6, wherein the scaling rate calculator compares the scaling rate and the current-limit-scaling rate and compensates the scaling rate to be equal to the current-limit-scaling rate when the current-limit-scaling rate is less than the scaling rate.

8. The application processor of claim 6, wherein the scaling rate calculator compensates the scaling rate in proportion to the current-limit-scaling rate.

9. The application processor of claim 1, wherein the image data includes sub image data for each sub-pixel, wherein the stress data includes sub stress data for each sub-pixel which includes sub-pixel degradation information, and wherein the scaling rate calculator selects maximum sub-pixel degradation information from a maximum sub stress data value and calculates sub scaling rate of the sub image data based on the maximum sub-pixel degradation information, wherein the image processor decreases a maximum gray scale value of the sub image data based on the sub scaling rate.

10. The application processor of claim 1, Wherein the scaling rate calculator periodically calculates the scaling rate with a first period, stores the scaling rate in a memory component, and updates the scaling rate stored in the memory component.

11. The application processor of claim 1, further comprising:

a stress calculator that generates the pixel degradation information by accumulating input grayscale values of the first image data for each pixel.

12. A display device comprising:

a display panel that includes a pixel;

an application processor that determines a scaling rate of first image data based on stress data that includes pixel degradation information and generates second image data by decreasing a maximum grayscale value of the first image data based on the scaling rate, the first image data being received from an external component;

a timing controller that generates third image data by compensating the second image data based on the pixel degradation information; and a data driver that generates a data voltage based on the third image data and transmits the data voltage to the pixel.

13. The display device of claim 12, wherein the application processor calculates the scaling rate of the first image data based on the pixel degradation information and a look-up table, and wherein the look-up table includes the scaling rate, wherein the scaling rate is predetermined based on the pixel degradation information.

14. The display device of claim 13, wherein the application processor selects maximum pixel degradation information from a maximum stress data value and calculates the scaling rate of the first image data based on the maximum pixel degradation information.

15. The display device of claim 14, wherein the look-up table further includes a compensation grayscale value that is calculated based on an input grayscale value of the first image data and the pixel degradation information, and wherein the timing controller generates the third image data based on the pixel degradation information, the second image data, and the look-up table.

16. The display device of claim 12, wherein the pixel includes sub-pixels, wherein the image data includes sub image data for each of the sub-pixels, wherein the stress data includes sub stress data for each of the sub-pixels which includes sub-pixel degradation information, and wherein the application processor selects maximum sub-pixel degradation information from a maximum sub stress data value and calculates a sub scaling rate of the sub image data based on the maximum sub-pixel degradation information.

* * * * *